US005179939A

United States Patent [19]

Donovan et al.

[11] Patent Number: 5,179,939

[45] Date of Patent: Jan. 19, 1993

[54] PASSIVE ANATOMIC SHOULDER EXERCISER

[75] Inventors: T. L. Donovan, Lompoc; R. J. Allemandi, Sunnyvale, both of Calif.

[73] Assignee: Sutter Corporation, San Diego, Calif.

[21] Appl. No.: 739,052

[22] Filed: Jul. 31, 1991

Related U.S. Application Data

[63] Continuation-in-part of Ser. No. 572,557, Aug. 27, 1990. abandoned.

[51] Int. Cl.[5] ..... A61H 1/02

[52] U.S. Cl. ..... 128/25 R; 482/4

[58] Field of Search ..... 128/24 R, 25 R; 602/20, 602/19; 482/4

[56] References Cited

U.S. PATENT DOCUMENTS

| | | | |
|---|---|---|---|
| 397,352 | 2/1989 | Gaertner . | |
| 440,765 | 5/1912 | Albert . | |
| 671,593 | 10/1965 | Perrine . | |
| 3,827,431 | 8/1974 | Pecorella | 602/20 |
| 3,892,230 | 9/1974 | Baker . | |
| 4,355,633 | 10/1981 | Heilbrum . | |
| 4,436,303 | 3/1982 | McKillip et al. . | |
| 4,478,213 | 8/1982 | Redding . | |
| 4,487,199 | 3/1983 | Savinger . | |
| 4,550,908 | 1/1984 | Dixon . | |
| 4,651,719 | 3/1987 | Funk et al. . | |
| 4,669,451 | 6/1987 | Blauth et al. . | |
| 4,720,099 | 1/1988 | Carlson . | |
| 4,757,992 | 7/1988 | Richard . | |
| 4,757,993 | 7/1988 | Rake . | |
| 4,768,783 | 8/1988 | Engalitcheff . | |
| 4,773,398 | 9/1988 | Tatom | 128/25 R |
| 4,773,399 | 9/1988 | Richardson . | |
| 4,811,944 | 3/1989 | Hoff . | |
| 4,842,272 | 6/1989 | Jennings . | |

*Primary Examiner*—Richard J. Apley
*Assistant Examiner*—Lynne A. Reichard
*Attorney, Agent, or Firm*—Nydegger & Associates

[57] ABSTRACT

A passive shoulder exerciser constructed to reciprocably move a patient's arm back and forth through an arc of up to 180° for providing flexion and abduction of the shoulder. The shoulder exerciser includes a base, an electric drive motor, and an arm holder for the patient's arm, mounted to the drive motor for reciprocal movement by the drive motor through an arc of up to 180°. The arm holder is slidably and pivotably mounted such that during use of the exerciser, a patient's arm may slide towards and away from the body and pivot along two pivot points to allow the shoulder joint to follow a natural anatomical range of motion. The shoulder exerciser is adjustable for use with either shoulder. Additionally, the shoulder exerciser is adjustable for a patient's height, arm length, and is adjustable with respect to speed and range of motion.

19 Claims, 6 Drawing Sheets

PASSIVE ANATOMIC SHOULDER EXERCISER

FIELD OF THE INVENTION

This is a continuation-in-part of co-pending application Ser. No. 07/572,557 filed on Aug. 27, 1990, now abandoned. This invention relates to exercise and rehabilitation equipment and more particularly to a continuous motion passive anatomic exerciser for rehabilitating shoulder injuries.

BACKGROUND OF THE INVENTION

Various anatomical exercise and therapy devices for exercising or conducting specific therapy movements of different muscle groups of a patient are well known in the art. As an example, continuous motion passive exercise machines have now become the standard of care for rehabilitation of joint injuries of injured or surgical patients.

In general, a passive motion exerciser moves a body part such as an arm or leg through a range of motion. This simulates the operation of the muscles and joints associated with the body part. Such passive motion exercisers may be continuous in motion and driven by electric motors or other continuous drive means. U.S. Pat. No. 4,355,633 to Heilbrun discloses such a passive exerciser apparatus that is motor driven.

Such passive exercise devices are useful for rehabilitating shoulder joint injuries or for rehabilitation following surgery of the shoulder, arms, or neck of a patient. A problem with such passive exercise devices, as related to shoulder joint rehabilitation, is that the prior art devices do not compensate for the anatomical movement of the shoulder joint and muscles during flexion or abduction of the shoulder.

As shown in FIG. 1, the shoulder joint structure includes a gleno humeral or glenoid joint which provides articulation for the humerus (i.e. upper arm bone) with respect to the flat triangular scapula (i.e. shoulder blade). Movement of the arm by various arm or shoulder muscles may universally rotate the humeral head within the glenoid joint as indicated by arrows 10. This is referred to as gleno-humeral motion.

In addition to gleno-humeral motion, the shoulder joint also undergoes scapula-thoracic motion. As shown in FIG. 1, the scapula lies within the dorsal lateral part of the thorax and is articulated with the clavicle. The scapula may be displaced from its position within the thorax by various arm and shoulder muscles as indicated by arrows 12. This is referred to as scapula thoracic motion. Rotation of the scapula accounts for about one third of total shoulder motion.

As a consequence of this shoulder joint structure, different movements of the shoulders and arms during exercise, produce different relative locations for the glenoid joint. These movements may include flexion and extension of the shoulder, shoulder flexion and abduction, and shoulder internal rotation. During each of these movements the center of rotation of the glenoid joint may change or shift within the shoulder. Prior art passive exercise devices typically account for gleno-humeral motion of the glenoid joint structure (i.e., universal rotation as indicated by arrows 10) but not scapula-thoracic motion of the joint structure (i.e. rotation of the scapula within the thorax as indicated by arrows 12). These prior art devices therefore apply a constant force to a fixed center of rotation. This does not accommodate the changing center of rotation of the shoulder joint caused by the combined gleno-humeral and scapulathoracic motions.

FIG. 2 illustrates the movement of the center of rotation of the shoulder joint (i.e., glenoid joint) during flexion of the shoulder. In FIG. 2 a patient 14 may flex his arm 16 through a range of motion from 0° to 180°. During flexion, in addition to the gleno-humeral motion of the glenoid joint, the joint also rises superiorly and rotates posteriorly due to scapula-thoracic motion. This motion changes the location of the center of rotation of the joint. For 50° flexion, a center of rotation is indicated by 18. For 180° flexion a center of rotation is indicated by 18'. Likewise, as shown in FIG. 3, during abduction of a patient's arm 16, from 50° to 180°, the center of rotation 18 may be shifted as indicated to 18'.

Since prior art exercise devices typically do not compensate for the relative movement of the glenoid joint caused by this scapula-thoracic motion, undue stresses may be induced by the arm and joint being held at a fixed center of rotation by points of attachment with the exerciser device. This may cause the patient to experience pain and discomfort and decrease the length and effectiveness of exercise. Additionally it may cause damage to the already injured shoulder joint and muscles. This problem may be further compounded if the patient changes position during exercise relative to the exercise device.

The shoulder exerciser of the invention, on the other hand, is constructed to allow the shoulder joint and muscles to follow a natural anatomic range of motion during flexion and abduction of the shoulder. The exerciser compensates for the changing center of rotation of the shoulder joint encountered during flexion and abduction of the shoulder through a 180° range of motion. This helps to prevent "jamming" or "stretching" of the glenoid joint and shoulder muscles, and helps minimizes painful stresses on the joint and muscles. Moreover, a patient may change his position, or the position of his arm relative to the exercise device of the invention, without the introduction of stress and discomfort in the glenoid joint and shoulder muscles.

SUMMARY OF THE INVENTION

In accordance with the present invention, a novel passive anatomic shoulder exerciser is provided. The exerciser is constructed to continuously move a patient's arm through an arc of up to 180° and back for providing combined passive flexion and abduction for the shoulder. The shoulder exerciser, simply stated, comprises: a base, a reciprocating drive means mounted to the base, and an arm holding means for holding a patient's arm for reciprocable movement (i.e. up and down) through an arc range of motion. The arm holding means in addition to reciprocating through an arc is pivotably and slidably mounted to the drive means for moving the patient's arm towards and away from the patient and for pivoting in two planes. The pivotal and slidable movement of the arm holding means as the patient's arm is moved through the arc range of motion, compensates for movement of the patient's glenoid joint (i.e. changing center of rotation) during the passive flexion and abduction of the shoulder structure. This permits the patient's arm to follow a natural anatomical path during the exercise.

The exerciser is adjustable for different arm lengths and for exercising either the left or the right arm. Additionally the degree of the arc range of motion and speed of the exerciser may be adjusted, as required. Moreover, the drive means of the invention may be constructed with a reversible drive motor or with a drive motor coupled to a drive linkage, for providing reciprocating motion for the arm holding means.

Other objects, advantages, and capabilities of the present invention will become more apparent as the description proceeds.

DESCRIPTION OF PREFERRED EMBODIMENTS

Figure 1:
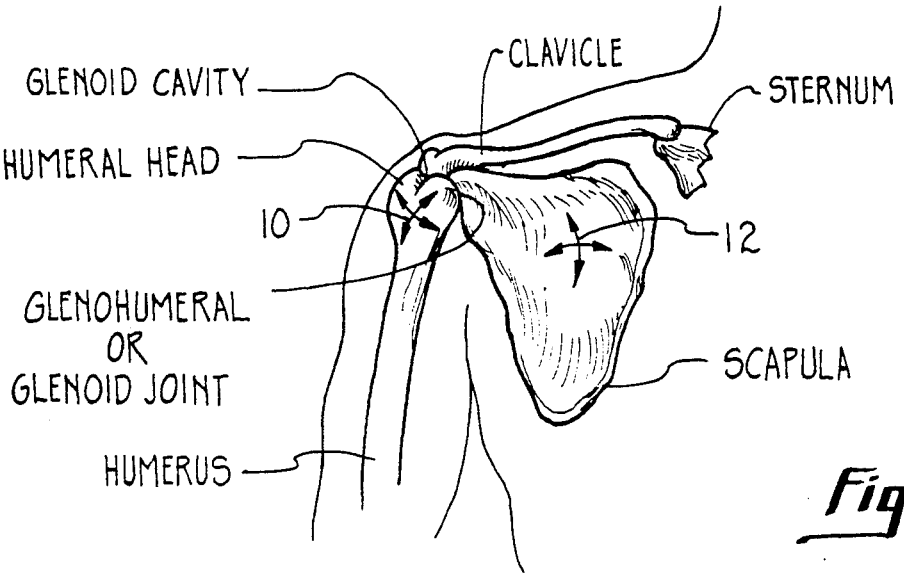
FIG. 1 is an anterior view of the bones and glenoid joint of a shoulder.
Figure 2:
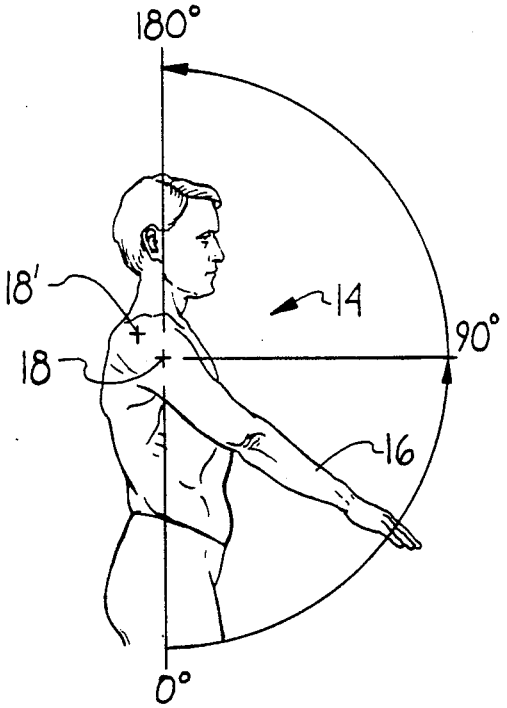
FIG. 2 is a side elevation view of a patient illustrating flexion of the patient's shoulder.
Figure 3:
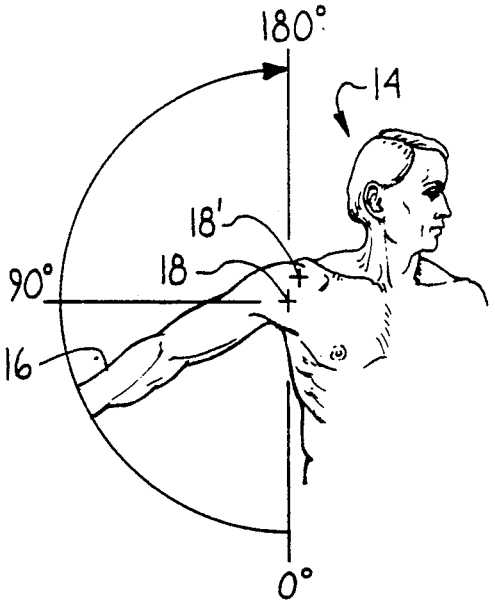
FIG. 3 is a front elevation view of a patient illustrating abduction of the patient's shoulder.
Figure 4A:
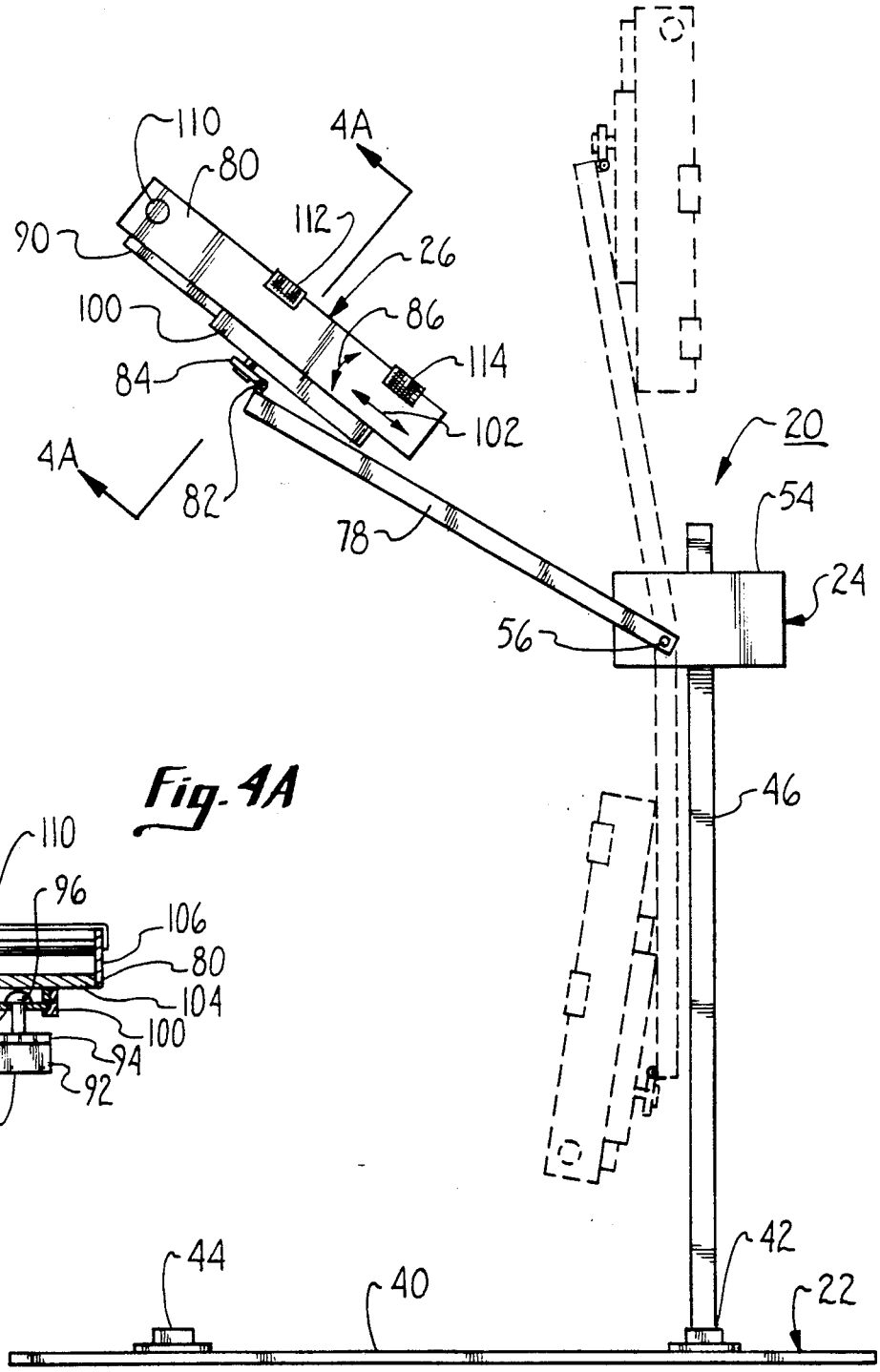
FIG. 4A is a cross section taken along line 4A—4A FIG. 4.
Figure 4:
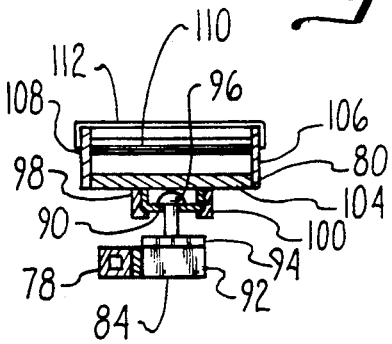
FIG. 4 is a side elevation view of a shoulder exerciser constructed in accordance with the invention.

Referring now to FIG. 4, an anatomic shoulder exerciser constructed in accordance with the invention is shown and generally designated as 20. The shoulder exerciser 20, generally stated, includes: a base 22, a reciprocating drive means 24 mounted to the base 22, and an arm holding means 26 pivotably and slidably mounted to the drive means 24 for holding a patient's arm for reciprocal movement by the drive means 24 through an arc of up to about 180°. In FIG. 4 the arm holding means 26 is shown at a location approximating flexion of 130°. Additionally the arm holding means 26 is shown in fathom at positions approximating 0° and 180° flexion of the shoulder.

Figure 5:
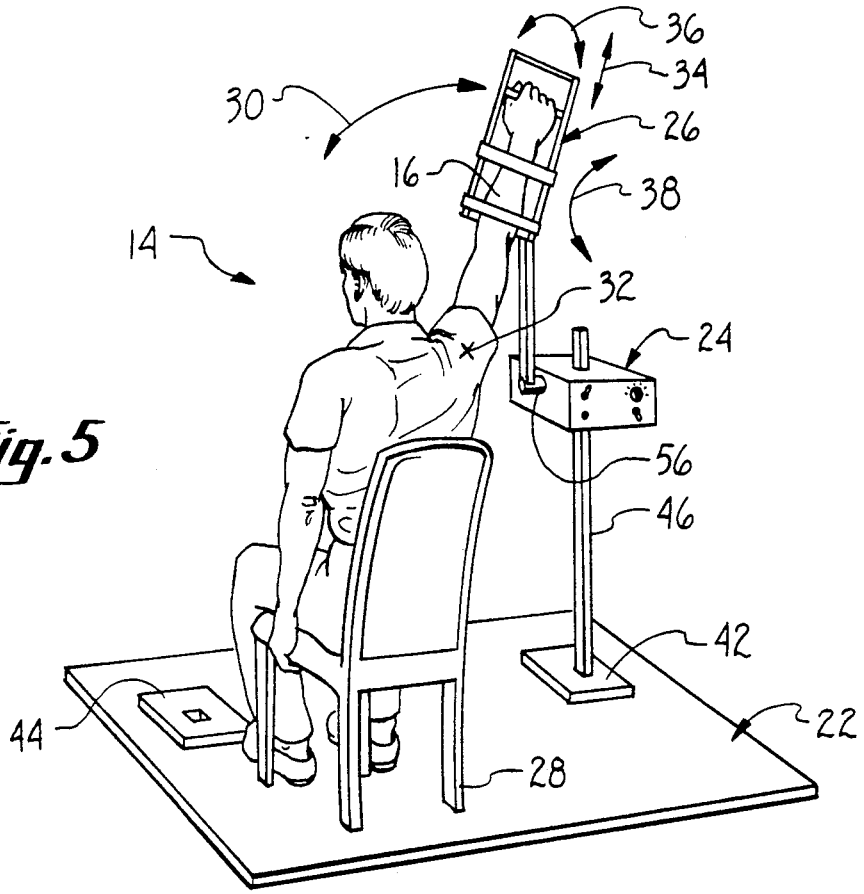
FIG. 5 is a perspective view of a patient using a shoulder exerciser constructed in accordance with the invention.

Referring to FIG. 5, the shoulder exerciser 20 is shown in use by a patient 14. For use while seated, a patient 14 sits in a chair 28, placed on the base 22, with the drive means 24 located adjacent to and at the same height as the patient's shoulder. The chair is placed to the side of the shoulder exerciser 20, i.e., about one foot away. The patient's arm 16 is strapped into the arm holding means 26. The drive means 24 continuously moves the arm holding means 26, and the patient's arm 16, through an arc of up to about 180° and back again as indicated by double headed arrow 30. The reciprocating movement of the arm holding means 26, through the arc 30, continuously flexes the patient's shoulder. Additionally, as shown in FIG. 5, the patient's arm is slightly abducted by the placement of shoulder exerciser 20, to the side of the chair 28. The arm holding means 26 in addition to being reciprocated through an arc of up to about 180° by the drive means 24, is mounted on a slide mounting means, and is free to slide away from and towards the patient 14 as indicated by arrow 34. Additionally, the arm holding means 26 is mounted on a pivot mounting means and is free to pivot about a first pivot point back and forth in a plane parallel with the arm 16, as indicated by double headed arrow 36. Moreover, the arm holding means 26 is free to pivot about a second pivot point back and forth in a plane orthogonal to the plane of the arm 16, as indicated by double headed arrow 38. With this arrangement, the patient's arm 16 is free to slide away from and towards the patient's body and pivot in two planes in response to the natural movement of the glenoid joint 32 during flexion-/abduction motion of the shoulder. The shoulder exerciser 20 thus replicates the changing center of rotation 32 and natural anatomical movement of the glenoid joint and shoulder muscles through a 180° range of motion. This helps prevent excessive strains and stresses in the joint and muscles. Moreover, if the patient 14 should change position in the chair 28, relative to the shoulder exerciser 20, the arm holding means 26 is again automatically repositioned or self-aligned by sliding and pivotal motions, to prevent stresses on the shoulder.

FIG. 5 illustrates just one use of the shoulder exerciser 20, with the patient 14, seated. The shoulder exerciser 20 can also be used with the patient either lying down or standing. Moreover, the patient may be located with respect to the shoulder exerciser 20 to accommodate his exact arm length and the shoulder exerciser 20 may be adjusted for use with either the right or the left shoulder of a patient 12.

Figure 6:
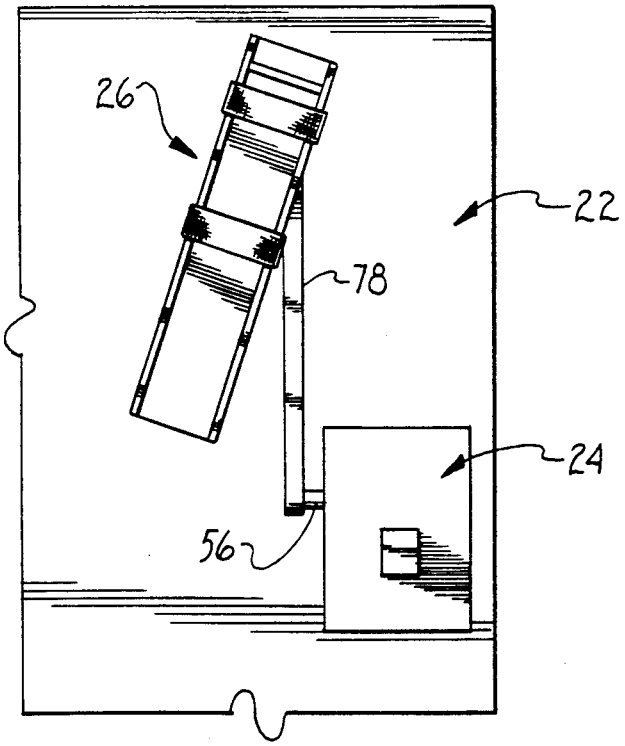
FIG. 6 is a plan view of FIG. 4.

Referring now to FIGS. 4 and 6, the individual components of the shoulder exerciser 20 will be explained in more detail. The base 22 includes a flat generally rectangular shaped base plate 40 adapted to rest on the floor. In use, the base plate 40 is held on the floor by the weight of the patient 14. Two flange members 42, 44 are permanently attached to the base plate 40 as a mounting means for a vertical upright member 46. Flange member 42 is referred to herein as a "right flange member" and is adapted to mount the upright member 46 to the base plate 40 for use with a patient's right arm. Flange member 44 is referred to herein as a "left flange member" and is adapted to mount the upright member 46 to the base plate 40 for use with a patient's left arm.

The drive means 24 in turn is adjustably mounted on the vertical upright member 46. The vertical upright member 46 may be generally square or rectangular in cross section and may be formed from square or rectangular metal or plastic tubing. The flange members 42, 44 are each formed with a recess corresponding in shape to the outer peripheral configuration of the vertical upright member 46. The vertical upright member 46 can thus be placed into and retained on the base plate 40 generally perpendicular to the plane of the base plate 40 by either flange members 42 or 44.

The base plate 40 and vertical upright member 46, shown in FIGS. 4 and 6, are suitable for use as shown in FIG. 5 by a patient seated in a chair 28. This base 22 can also be used to accommodate a standing patient or a patient lying in a bed. Base 22, however, is merely illustrative and other configurations would also be possible.

Figure 7:
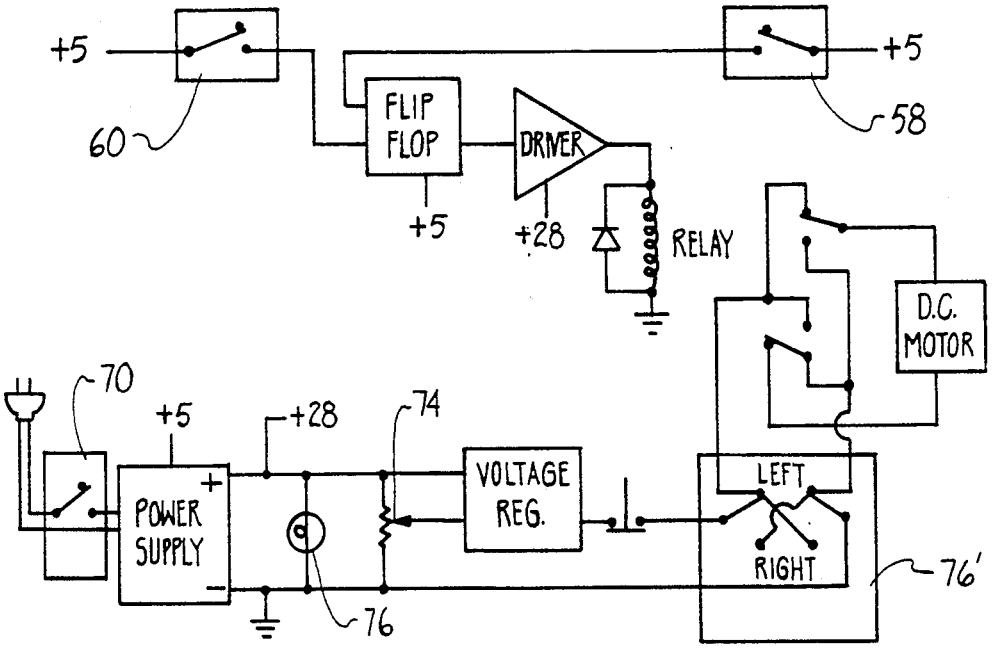
FIG. 7 is an electrical schematic of a drive means for the exerciser of FIG. 4.
Figure 8:
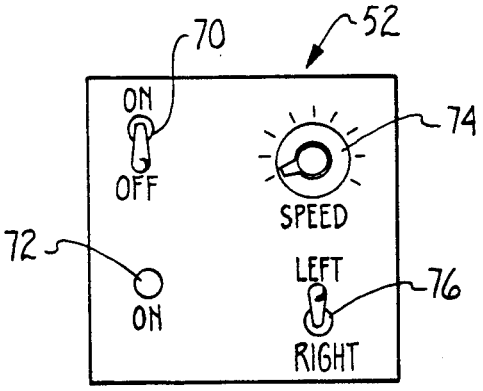
FIG. 8 is a front elevation view of a control panel of the exerciser of FIG. 4.
Figure 9:
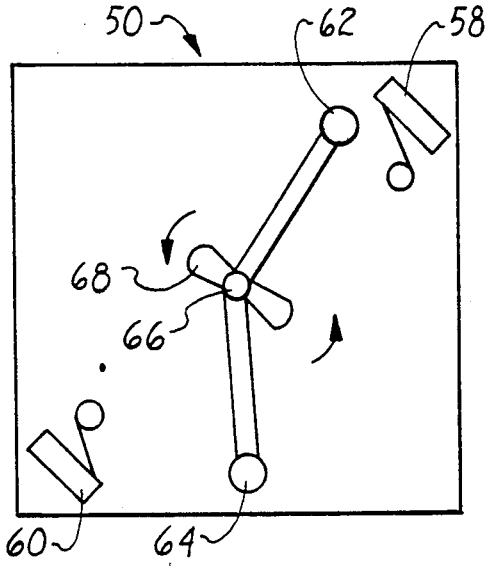
FIG. 9 is a side elevation view of a control means for adjusting the movement of the exerciser of FIG. 4 through an arc range of up to 180°.

The drive means 24 will now be explained in more detail. As shown in FIG. 4. the drive means 24 is adjustably mounted upon the vertical upright member 46. As previously stated, the drive means is adapted to provide reciprocating motion for the arm holding means 26 through an arc range of motion of up to about 180°. With reference to FIGS. 7, 8, and 9, the drive means may include, a drive motor 48 (FIG. 7), control means 50 (FIG. 9) for converting and adjusting the rotational output of the drive motor 48, into a reciprocating motion, and control panel means 52 (FIG. 8) for adjusting the speed and direction of the drive motor 48. All of the drive means components may be mounted in a housing 54 (FIG. 4). The housing 54 may be a generally box like enclosure adapted to be vertically adjustably mounted to the vertical upright member 46 by means of set screws, threaded knobs (not shown), or the like.

Figure 11:
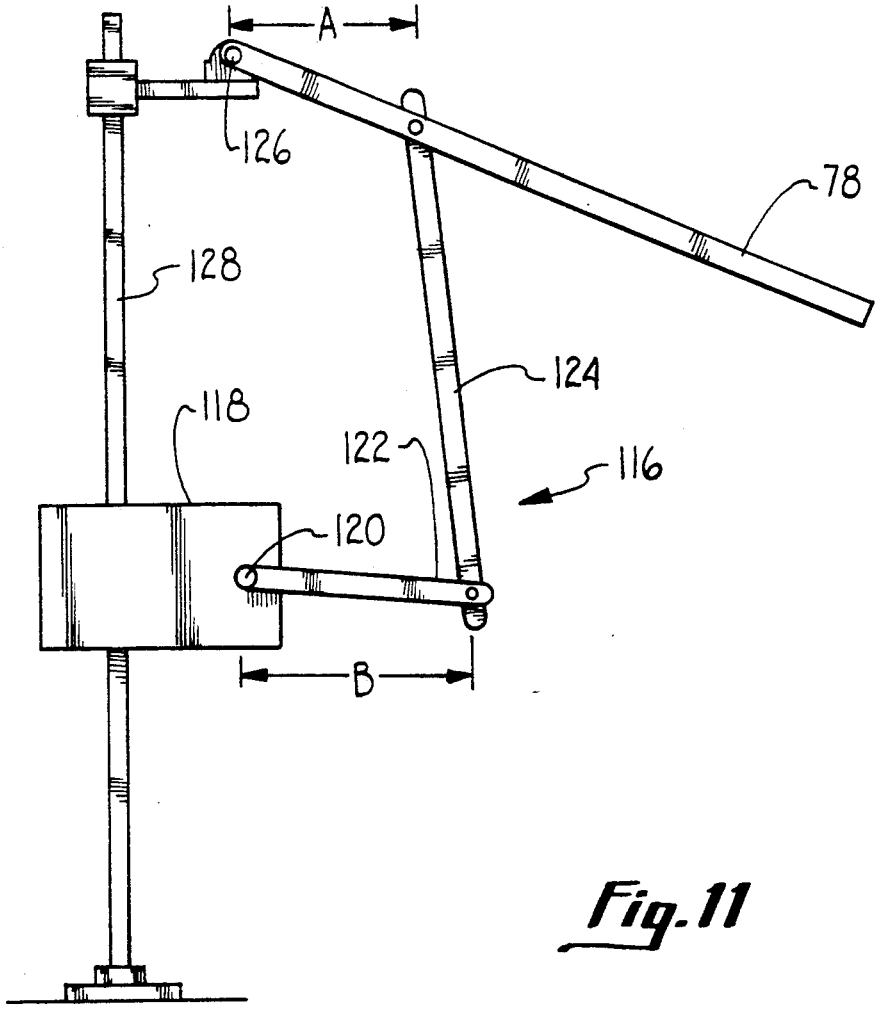
FIG. 11 is a side elevation view of a shoulder exerciser constructed in accordance with the invention with an alternate embodiment drive means.

In the illustrative embodiment, shown in FIG. 4, the drive motor 48 is a variable speed and reversible direction electric motor coupled to a speed reducer for producing a relatively low rpm output (i.e. 1–100 rpm). The output of this drive motor 48 must then be adapted to produce reciprocating movement of the arm holding means 26 through an arc of up to 180°. In the embodiment shown in FIG. 4, this is done by rotating the output shaft 56 of the drive motor through a desired arc and then reversing the direction of motion. Alternately, as shown in FIG. 11 and which will hereinafter be explained, reciprocating motion for the arm holding means 26 can be achieved with a drive linkage such as a three bar linkage for converting rotary motion of the output shaft to reciprocating motion.

In the embodiment of FIG. 4, the output shaft 56 of the drive motor 48 is coupled by single drive linkage 78 to the arm holding means 26 for moving the arm holding means 26 through an arc of up to about 180° and back again in a continuous manner. This reciprocating motion is derived from the drive motor 48 and adjusted by the control means shown in FIG. 9.

With reference to FIG. 9, the control means 50 includes a pair of spring biased limit switches 58, 60 operated by setting levers 62 and 64 respectively. The setting levers 62, 64 are adjustably mounted upon a control shaft 66 which is mechanically coupled to the output shaft 56 of the drive motor 48. The relative location of the setting levers 62, 64 upon the control shaft 66 is adjustable by a suitable adjustable fastening means such as a wing nut 68. The wiring arrangement of the micro switches 58, 60 with the motor 48 is shown in FIG. 7.

In use the control shaft 66 rotates along with the output shaft 56 of the drive motor 48. The direction of rotation of the drive motor 48 is stopped and flip-flopped by contact of a setting lever 62 or 64 with spring biased limit switches 58 or 60. The reversible drive motor 48 is thus energized to rotate in either a clockwise (CW) or counter clockwise (CCW) direction through an arc determined by the location of the setting levers 62, 64 with respect to the limit switches 58, 60. This arc is preferably in the range of 0° to 180°.

With reference to FIG. 8 the control panel means 52 includes an on-off switch 70 wired to the motor. Additionally an indicator light 72 may be wired in line with the on-off switch to indicate operation of the drive motor 48. The control panel means 52 also includes a speed adjustment means 74, such as a rheostat which may be internal to the motor, for varying the output speed of the motor (i.e. 0–100 rpm). Additionally the control panel means may include a selector switch 76 that flip flops the location of the limit switches 58 and 60 with respect to one another in order to determine which switch 58 or 60 will be used for forward direction and which switch will be used for reverse direction (i.e. initial setting). A suitable wiring diagram for these components is shown in FIG. 7. The circuit of FIG. 7 works as follows:

1. On/off switch 70 turns on the power; light 76 goes on.
2. The speed of the motor 48 (M1) can be regulated by adjusting the voltage with resistor 74.
3. Switch 76 reverses the voltage on the motor 48 for selection of left arm or right arm.
4. Limit switch 60 is momentarily closed when setting level 64 (FIG. 9) bumps it. This resets the flip flop (F/F) and the driver is turned off, relay K, drops out, the contacts change, reversing the motor 48. The motor 48 goes in this direction until its setting lever 66 closes limit switch 58. This causes the F/F to set which in turn causes the driver to close relay K, which then reverses the direction of rotation of motor 48.
5. The motor 48 is shown as a D.C. motor but may also be a reversible A.C. motor.

Alternately, other control means 50 may be utilized to convert rotary motion of an output shaft 56 into reciprocating motion through an adjustable arc. As will hereinafter be more fully explained, a mechanical linkage such as that shown in FIG. 11 may be utilized to convert rotation of the output shaft 56 into reciprocating motion for the arm holding means 26.

In FIGS. 4 and 5 the exerciser 20 is illustrated in use with a patient's right arm. In FIG. 4, the arm holding means 26 will rotate clockwise for lifting the right arm and will rotate counterclockwise to lower the right arm. These directions of motion will be reversed for left shoulder exercise. For the right arm, the vertical upright 46 of the base 22 is mounted in the right flange member 44 and the drive means 24 is located with the output shaft 56 facing the patient 14. Setting lever 62 reverses the direction of rotation of the drive motor 48 when the arm holding means 26 is at about 0°. Setting lever 64 is adjusted to control the arc range of motion or the height of the right arm as it is rotated. For exercising a patient's left arm, the chair 28 may be turned around. The exerciser 20 is then turned 180° and the output shaft 56 is positioned adjacent to the left shoulder. The setting levers 62, 64 (FIG. 9) may then be switched with switch 76 so that setting lever 64 reverses the direction of rotation of the drive motor 48 when the arm holding means 26 is at 0°. Setting lever 62 is adjusted to control the arc range of motion or the height of the left arm as it is rotated.

Referring again to FIG. 4, the construction of the arm holding means 26 will be explained in detail. The arm holding means 26, generally stated, includes the power linkage 78, drivably coupled to the output shaft 56 of the drive motor 48, and an arm rest 80 pivotably and slidably mounted to the power linkage 78.

The power linkage 78 is a rigid element which may be rectangular in cross section as shown, and formed of metal tubing, bar stock or the like. The power linkage 78 may be drivably coupled to the output shaft 56 of the drive motor 48 by set screws or keys for rotation therewith. A generally L-shaped mounting plate 82 is attached to an end of the power linkage 78 for mounting the arm rest 80 thereon offset from the power linkage 78. The shape of the mounting plate 82 for the arm rest 80 is clearly shown in FIG. 10.

The arm rest 80 is pivotably mounted on the mounting plate 82 for pivoting in two planes, with a universal hinge 84. Universal hinge 84 is constructed to allow the arm rest 80 to pivot up and down with respect to the power linkage 78 as indicated in FIG. 4 by double headed arrow 86. Stated differently the arm rest 80 may pivot in a plane orthogonal to a longitudinal axis of the power linkage 78 and to a plane of the arm rest 80 and the patient's arm 16.

Figure 10:
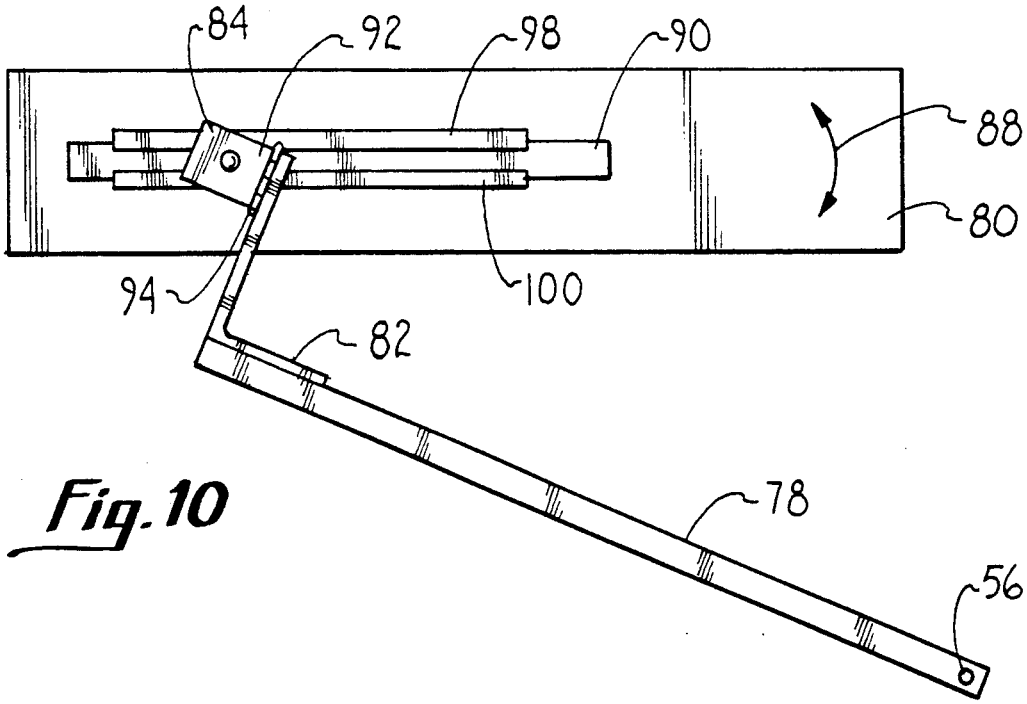
FIG. 10 is a bottom view of an arm holding means of the shoulder exerciser of FIG. 4.

As shown in FIG. 10 the universal hinge 84 is also constructed to allow the arm rest 80 to pivot towards and away from the power linkage 78 as indicated by double headed arrow 88 in FIG. 10. Stated differently the arm rest 80 may pivot back and forth in a plane coincident with or parallel to that of the arm rest 80 and the patient's arm 16.

As shown in FIG. 4A this compound pivot may be achieved with the universal hinge 84 constructed with two hinged sections 92, 94. A first hinged section 92 of the universal hinge 84 is fixedly attached to the mounting plate 82 of the power linkage 78. A second hinged section 94, of the universal hinge 84, is attached at a single point to the arm rest 80. This single point connection may be accomplished with a pin connector 96 or the like permitting relative movement between the arm rest 80 and universal hinge 84 in a plane parallel to that of the arm rest 80.

The arm rest 80 is also slidably mounted with respect to the power linkage 78 on a slide mounting means. As shown in FIG. 4A, the slide mounting means may include a stationary slide mount 90 attached to the universal hinge 84 by pin connector 96, and spaced parallel L-shaped guide tracks 98, 100 attached to the arm rest 80. As denoted by double headed arrow 102 in FIG. 4, the arm rest 80 is free to slide towards and away from the center of rotation of the drive means 24 and the patient 14.

The arm rest 80 is constructed to cradle the patient's arm. As shown in FIG. 4A the arm rest may be generally u-shaped in cross section formed with a bottom plate 104 and parallel spaced side plates 106, 108. A hand grip 110 is mounted to the side plates 106, 108 of the arm rest 80 which can be grasped by the patient's hand. The hand grip 110 may also be adjustably mounted on the arm rest 80 (not shown). The arm rest 80 also includes straps 112, 114 fastened in the side plates 106 or 108. The straps 112, 114 may be formed with hook and loop fasteners (such as Velcro TM fasteners) for securing the patient's arm 16 to the arm rest 80.

When in use as shown in FIG. 5, the arm rest 80 is free to slide on stationary slide mount 90 as indicated by arrow 34 for moving the patient's arm towards and away from the center of rotation and the patient's body. Additionally, the arm rest 80 is free to pivot about a first pivot point formed by universal hinge 84 (i.e. hinged leafs 92 and 94) as indicated by arrow 38 in a plane orthogonal to the plane of the arm. Finally the arm rest is free to pivot about a second pivot point formed by pin connector 96 and universal hinge 84 as indicated by arrow 36 (FIG. 5) in a plane parallel to or coincident with the arm.

Referring now to FIG. 11 an alternative embodiment shoulder exerciser 116 having a different drive means 118 for reciprocably moving arm holding means 26 through an arc range of motion and back again is shown. Drive means 118 includes a three bar linkage for transforming rotary motion from a drive shaft 120 into reciprocating motion by the drive linkage 78 through an arc range of almost 180° or approximately 170°. This permits a drive motor to operate in a single direction of rotation (CW or CCW) and there is no need for a reversible drive motor and for the control means 50 as previously explained for the embodiment of FIG. 4.

The three bar linkage includes a first linkage element 122 drivably coupled to the drive shaft 120. First linkage element 122 is pivotally connected to a second linkage element 124. Second linkage element 124 in turn is pivotably connected to the power linkage 78 for the arm holding means 26 (not shown). The power linkage 78 is also pivotably mounted to a bearing block 126 which is adjustably mounted to a vertical upright 128 attached to the base as before. The distance "A" in FIG. 11 must be smaller than the distance "B" to prevent the power linkage 78 from rotating 360°. With distance "A" smaller than distance "B" the power linkage 78 will reciprocate through an arc. The arc length of movement can be adjusted by changing distance "A" while holding distance "B" constant or by changing distance "B" while holding "A" constant. With this configuration an arc range of about 170° is possible.

Figure 12:
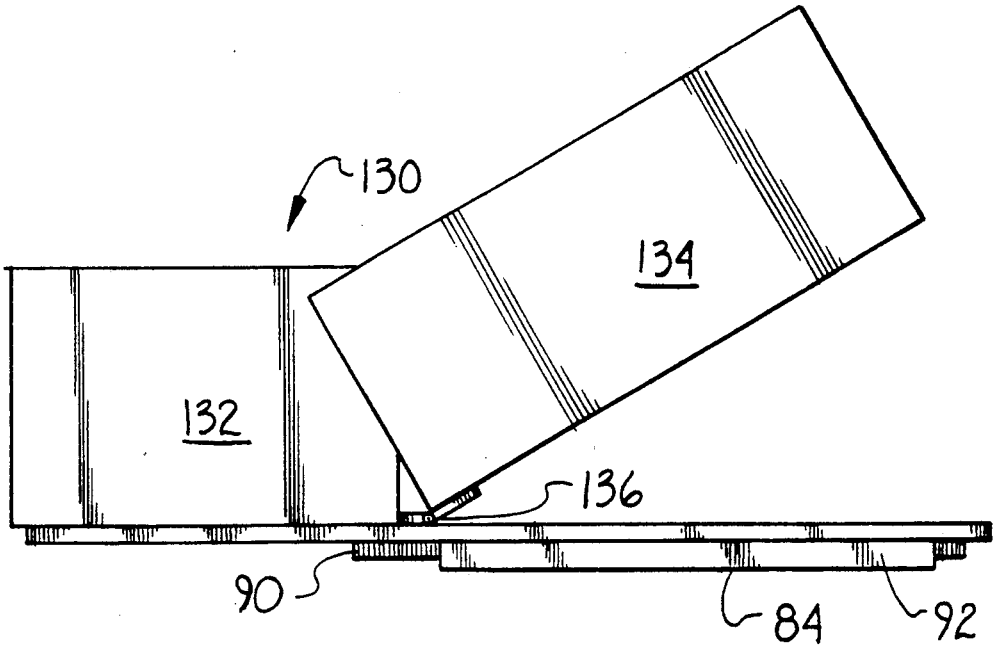
FIG. 12 is a side elevation view of an alternate embodiment arm holding means for a shoulder exerciser constructed in accordance with the invention.
Figure 13:
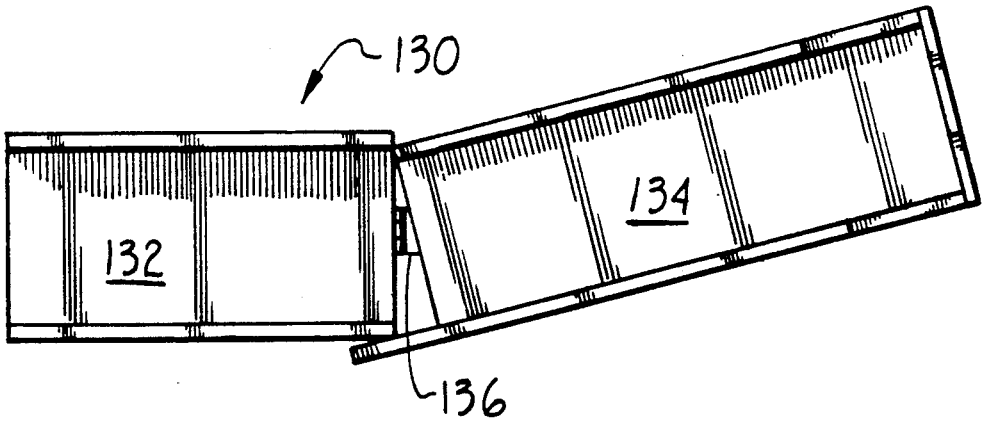
FIG. 13 is a plan view of FIG. 12.

Referring now to FIGS. 12 and 13, an alternate embodiment arm holder 130 is shown. Alternate embodiment arm holder 130 includes an upper arm holder 132 and a lower arm holder 134. A hinged connection 136 pivotably connects the upper arm holder 132 to the lower arm holder 134. The hinged connection 136 also supports a stationary slide member (i.e. stationary slide member 90) for sliding motion as previously described. The alternate embodiment arm holder 130 can be used to elevate and rotate the lower arm with respect to the upper arm during use of the shoulder exerciser.

Thus the invention provides a novel shoulder exerciser which allows the shoulder joint of a patient to follow an anatomical range of motion during passive flexion/abduction of the shoulder.

While the invention has been described with reference to preferred embodiments thereof, as will be apparent to those skilled in the art, certain changes and modifications can be made without departing from the scope of the invention as defined by the following claims:

We claim:

1. A shoulder exerciser comprising:

a base;

a drive means mounted to the base and including a rotatable drive linkage;

an arm holding means for holding a patient's arm including slide mounting means for freely slidably mounting the arm holding means to the drive linkage for permitting the patient's arm to slide towards and away from the patient; and pivot mounting means for pivotably mounting the arm holding means to the drive linkage for pivoting along a first pivot point in a plane generally orthogonal to a plane of the patient's arm and along a second pivot point in a plane generally parallel to the patient's arm such that the patient's arm can be held by the arm holding means and moved up and down for flexing and abducting the patient's shoulder with the arm holding means freely sliding and pivoting to compensate for anatomical movement and a changing center of motion of the patient's shoulder joint.

2. The shoulder exerciser as claimed in claim 1 and wherein:

the drive means includes a drive motor connected to a drive linkage for moving the arm holder means through an arc of up to about 180°.

3. The shoulder exerciser as claimed in claim 2 and wherein:

the drive means comprises an electric motor; and the drive linkage is coupled to a three bar linkage for transforming rotary motion of an output shaft of the drive motor to reciprocating motion through an arc of up to about 180°.

4. The shoulder exerciser as claimed in claim 2 and further comprising:

control means for adjustably controlling movement of the arm holding means through an arc of up to about 180°.

5. The shoulder exerciser as claimed in claim 4 and wherein:

the drive means comprises a reversible electric motor; and the control means stops and reverses directions of an output shaft of the motor to reciprocably move the arm holding means through an arc of up to 180°.

6. The shoulder exerciser as claimed in claim 5 and wherein the control means comprises:

a pair of limit switches arranged in electrical contact with the drive motor for stopping and reversing directions of the output shaft of the drive motor upon actuation of one of the limit switches; and a pair of levers coupled to the output shaft of the drive motor to actuate the limit switches adjustable to control a degree of rotation of the output shaft.

7. A shoulder exerciser comprising:

a base;

a drive means mounted to the base including a drive motor having a drive shaft connected to a drive linkage adapted to reciprocate back and forth through an arc range of motion;

an arm holding means for retaining a patient's arm with the arm holding means slidably and pivotably connected to the drive linkage;

slide mounting means for the arm holding means for moving the arm holding means generally along the drive linkage towards and away from the patient;

a pivot mounting means for the arm holding means including a hinge having a first hinge section and a second hinge section, with the first hinge section attached to the drive linkage and the second hinge section attached to the arm holding means by a pin connection for universal movement of the arm holding means with respect to the second hinge section whereby the arm holding means may pivot in two planes; and control means for adjusting a range of motion of the arm holding means whereby the patient's arm can be held by the arm holding means and moved up and down for flexing and abducting the patient's shoulder with the arm holding means freely sliding and pivoting with respect to the drive linkage to compensate for anatomical movement and a changing center of motion of the patient's shoulder joint.

8. The shoulder exerciser as claimed in claim 7 and wherein the base comprises:

a base plate; and a vertical upright mounted to the base plate for adjustably mounting the drive means.

9. The shoulder exerciser as claimed in claim 7 and wherein the drive means comprises:

an electric drive motor; and the control means transforms rotary motion of an output shaft of the drive motor to reciprocating motion through an arc of up to about 180°.

10. The shoulder exerciser as claimed in claim 9 and wherein:

the drive motor is a reversible direction variable speed electric motor; and a rotational control means for the drive motor includes a control shaft, setting levers adjustably mounted to the control shaft, and a pair of limit switches electrically connected to the drive motor and operable by the setting levers to stop and reverse direction of the drive motor such that the drive linkage may be reciprocated through an arc which is adjustable from 0° to about 180°.

11. The shoulder exerciser as claimed in claim 7 and wherein:

the drive means is a variable speed electric drive motor; and an output shaft of the drive motor is coupled to a three bar linkage for transforming rotary motion of the output shaft into reciprocating motion through an arc with the linkage adjustable to produce an arc of between 0° to about 180°.

12. The shoulder exerciser as claimed in claim 11 and wherein:

the arm holding means includes a generally u-shaped arm holder and a strap for strapping the patients' arm to the arm holder.

13. The shoulder exerciser as claimed in claim 7 and wherein:

the arm holding means includes a hand grip.

14. The shoulder exerciser as claimed in claim 13 and wherein:

the arm holder includes an upper arm holder hingedly mounted to a lower arm holder for movement of the upper arm with respect to the lower arm.

15. A passive anatomical shoulder exerciser comprising:

a base including a base plate and a vertical upright;

a drive means adjustably mountable to the vertical upright and including a reversible drive motor having an output shaft;

a drive linkage drivably coupled to the output shaft;

control means operably associated with the drive motor for stopping and reversing directions of the drive motor to reciprocably move the drive linkage through an arc range of motion; and an arm holder freely pivotably and slidably mounted to the drive linkage on a slide mounting means with the slide mounting means pivotably attached to a pin connector to a hinge with the hinge having a first hinge section for attachment to the pin connector and a second hinge section for attachment to the drive linkage;

whereby a patient's arm may be held in the arm holder and the arm holder reciprocated by the drive linkage through an arc for flexing the patient's shoulder and with the patient's arm free to move towards and away from the patient generally along an axis of the drive linkage and free to pivot in two planes orthogonal to one another to compensate for movement of the patient's shoulder joint during flexion or abduction.

16. The shoulder exerciser as claimed in claim 15 and wherein:

the base plate includes separate vertical upright mounting means for mounting the vertical upright on either a right side or left side of the patient.

17. The shoulder exerciser as claimed in claim 15 and wherein:

the arm holder includes a hand grip for the patient's hand.

18. The shoulder exerciser as claimed in claim 15 and wherein:

the arm holder includes an upper arm holder hinged with respect to a lower arm holder for movement of the upper arm with respect to the lower arm.

19. The shoulder exerciser as claimed in claim 15 and wherein:

the drive motor is a variable speed electric motor.

* * * * *